US005390410A

United States Patent [19]

Takenami et al.

[11] Patent Number: 5,390,410

[45] Date of Patent: Feb. 21, 1995

[54] TERMINAL CRIMPING APPARATUS

[75] Inventors: Yoshio Takenami; Eiji Fudoo, both of Yokkaichi, Japan

[73] Assignee: Sumitomo Wiring Systems, Ltd., Japan

[21] Appl. No.: 110,790

[22] Filed: Aug. 23, 1993

[30] Foreign Application Priority Data

Sep. 1, 1992 [JP] Japan ..... 4-233934

[51] Int. Cl.[6] ..... H01R 43/048; B21D 37/12

[52] U.S. Cl. ..... 29/753; 29/863; 72/412

[58] Field of Search ..... 29/33 M, 747, 748, 753, 29/882, 863; 72/410, 412

[56] References Cited

U.S. PATENT DOCUMENTS

| | | | |
|---|---|---|---|
| 3,253,451 | 5/1966 | Kerns et al. | 72/412 X |
| 3,866,294 | 2/1975 | McCaughey | 29/753 X |
| 4,048,839 | 9/1977 | Peterpaul | 29/753 X |
| 4,216,668 | 8/1980 | Walton, II | 72/410 X |
| 5,099,570 | 3/1992 | Gerhard, Jr. | 29/753 X |

OTHER PUBLICATIONS

Japanese Patent Laid-Open Gazette No. 1-232680.
Japanese Patent Laid-Open Gazette No. 3-165478.
Japanese Patent Laid-Open Gazette No. 3-98278.

*Primary Examiner*—Peter Dungba Vo
*Attorney, Agent, or Firm*—Beveridge, DeGrandi, Weilacher & Young

[57] ABSTRACT

The present invention is directed to a terminal crimping apparatus comprising a pressure receiving member having a pressure receiving surface receiving a crimped terminal loaded in a connector housing, a caulking member having a crimping surface, for caulking the crimped terminal in the connector housing between the caulking member and the pressure receiving member, a surrounding member integrally extending from the caulking member and adapted to pass through the connector housing toward the pressure receiving member, for surrounding the pressure receiving member with little clearance, and a regulating member for preventing the surrounding member from being deformed at the time of caulking the crimped terminal.

16 Claims, 6 Drawing Sheets

TERMINAL CRIMPING APPARATUS

CROSS REFERENCE TO RELATED APPLICATION

This application claims priority benefits under 35 USC § 119 of Japanese Patent Application Ser. No. 4-233934, filed Sep. 1, 1992, the disclosure of which is incorporated by reference.

BACKGROUND OF THE INVENTION

1. Field of the Invention

The present invention relates generally to a terminal crimping apparatus for caulking, in a connector housing, a so-called crimped terminal loaded in the connector housing to crimp the crimped terminal against an end of an electric wire.

2. Description of the Related Art

As a terminal for electrically connecting electric wires to each other, a so-called press-connecting terminal and a crimped terminal have been generally known. The press-connecting terminal is of such a type as to pinch a conductor of an electric wire between a pair of blade parts integrally extend from the terminal so as to electrically connect the terminal with the conductor by the pinching force. Press-connecting terminal is mainly used for a weak current. On the other hand, the crimped terminal is such a type as to previously strip a conductor in an end of an electric wire and crimp a pair of wire barrels so provided as to integrally extend from the terminal in a predetermined configuration to electrically connect the stripped conductor and the terminal to each other. Crimped terminal is mainly used for a strong current.

The crimped terminal has higher tensile strength and is more reliably rendered conductive as compared with the press-connecting terminal, so the crimped terminal is widely employed in the field in which reliability is required.

The present invention is suitable for a crimping connector of such a type as to electrically connect the above described crimped terminal and the electric wire to each other inside a connector housing. Such a crimping connector has been already widely provided (see, for example, Japanese Patent Laid-Open Gazette No. 1-232680 and Japanese Patent Laid-Open Gazette No. 3-165478).

This crimping connector is provided with openings 101 and 102 formed in opposite sides of a connector housing 100. Openings 101 and 102 are so covered with covers 103 and 104 that they can be opened and closed, as shown in FIGS. 3A and 3B. A plurality of crimped terminal inserting portions 105 are provided side by side inside the connector housing 100. In this crimping connector, a wire barrel A1 is caulked into a predetermined configuration as shown in FIG. 3A or 3B by a terminal crimping apparatus as described later. In an caulking operation of the terminal crimping apparatus, a crimped terminal A is loaded in each of the crimped terminal inserting portions 105 and a conductor W1 of an electric wire W is stripped to be joined to the crimped terminal A, thereby to make it possible to crimp the wire barrel A1 against the conductor W1 in an end of the electric wire W. An insulation barrel A2 of the crimped terminal A is also pressed by the apparatus at a time in a state where the barrel A2 is received by the bottom of the connector housing 100, thereby to make it possible to crimp the insulation barrel A2 against a coated end W2 of the electric wire W.

Such a crimping connector has the advantage that crimping work of the electric wire W and the crimped terminal A can be easily and quickly performed, and is significantly suitable particularly in automating the fabrication of a wiring harness.

The above described terminal crimping apparatus comprises an anvil 107 and a crimper 108 disposed in close proximity to each other and are so opposed to each other as to interpose a connector housing 100 therebetween, as shown in FIG. 4. The tip of the anvil 107 is introduced into a crimped terminal inserting portion 105 of the connector housing 100 and the crimper 108 is lowered by pressing means from above state, thereby to make it possible to interpose and caulk a wire barrel A1 of a crimped terminal A between the crimper 108 and the anvil 107.

In a wiring harness for, for example, an automobile which is repeatedly subjected to violent vibration, a wire barrel A1 of a crimped terminal A must be very firmly crimped against a conductor W1 of an electric wire W so as to reliably maintain conduction between the conductor W1 of the electric wire W and the crimped terminal A for a long time period. In the terminal crimping apparatus of the above described construction, however, a clearance S is formed between the crimper 108 and the anvil 107, thereby making it impossible to obtain the desired connecting intensity because the crimped terminal A escapes to the clearance S even if pressure applied to the crimper 108 is increased.

Meanwhile, in general crimping of a terminal against an electric wire for a large current, a terminal crimping apparatus is used for crimping a terminal without forming the above described clearance S (see, for example, Japanese Patent Laid-Open Gazette No. 98278/1991).

As shown in FIG. 5, such a terminal crimping apparatus is provided at a lower part of a crimper 108 with a substantially U-shaped surrounding portion **108*a* which receives an anvil 107 with no clearance in order to surround the crimped terminal A with no clearance, and so adapted that the crimper 108 is pressed by applying high pressure for ensuring the desired connecting intensity to decrease the contact resistance in a crimped portion. This type of terminal crimping apparatus cannot be applied to a crimping connector for crimping a terminal in a housing as described above due to the following problem. Specifically, in a crimping connector used for a wiring harness, the width of the crimped terminal inserting portion 105 is narrow, as shown in FIG. 3. Consequently, an attempt to use the terminal crimping apparatus shown in FIG. 5 is interrupted by the surrounding portion 108*a* having a large wall thickness t. If this surrounding portion 108*a* were thin, the intensity of the surrounding portion 108*a* would be insufficient: the surrounding portion 108*a* would be spaced farther apart in caulking the crimped terminal A, so that a clearance would be formed between the crimper 108 and the anvil 107**. Consequently, it is difficult to actually apply the terminal crimping apparatus to crimping of a terminal in a crimping connector.

SUMMARY OF THE INVENTION

The present invention has been made in view of the above described problems and has for its object to provide a terminal crimping apparatus capable of crimping a terminal in a crimping connector reliably and firmly.

The present invention is directed to a terminal crimping apparatus which attains the above described object. Specifically, the present invention includes a member for caulking a crimped terminal inside a connector housing. With a new structure according to the present invention, the member carries out a caulking process with no place to which the crimped terminal being caulked escapes. In the present invention, therefore, even when the above described crimped terminal and an electric wire are electrically connected to each other inside the connector housing, it is possible to sufficiently ensure connecting intensity of the crimped terminal and therefore, to make it possible to maintain conduction between the electric wire and the crimped terminal reliably for a long time period.

The foregoing and other objects, features, aspects and advantages of the present invention will become more apparent from the following detailed description of the present invention when taken in conjunction with the accompanying drawings.

DESCRIPTION OF PREFERRED EMBODIMENTS

Figure 1:
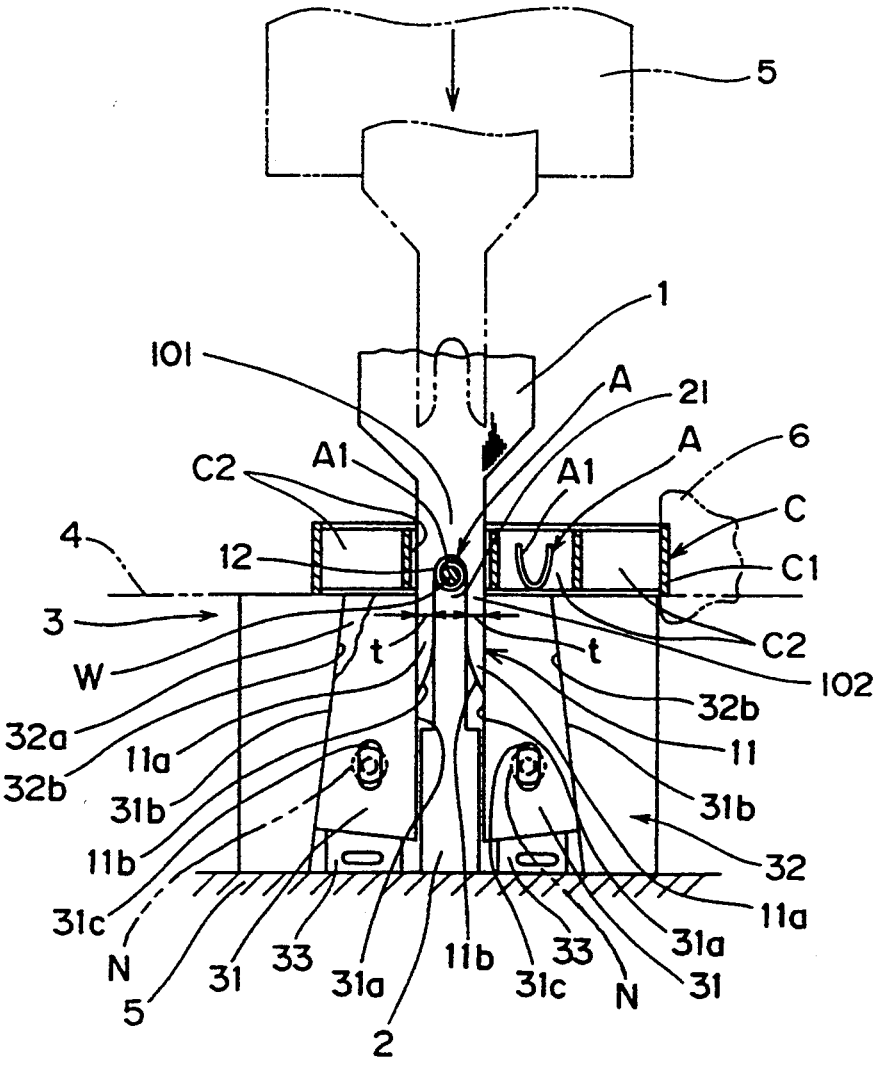
FIG. 1 is a front view showing main parts of a terminal crimping apparatus according to the present invention.
Figure 2:
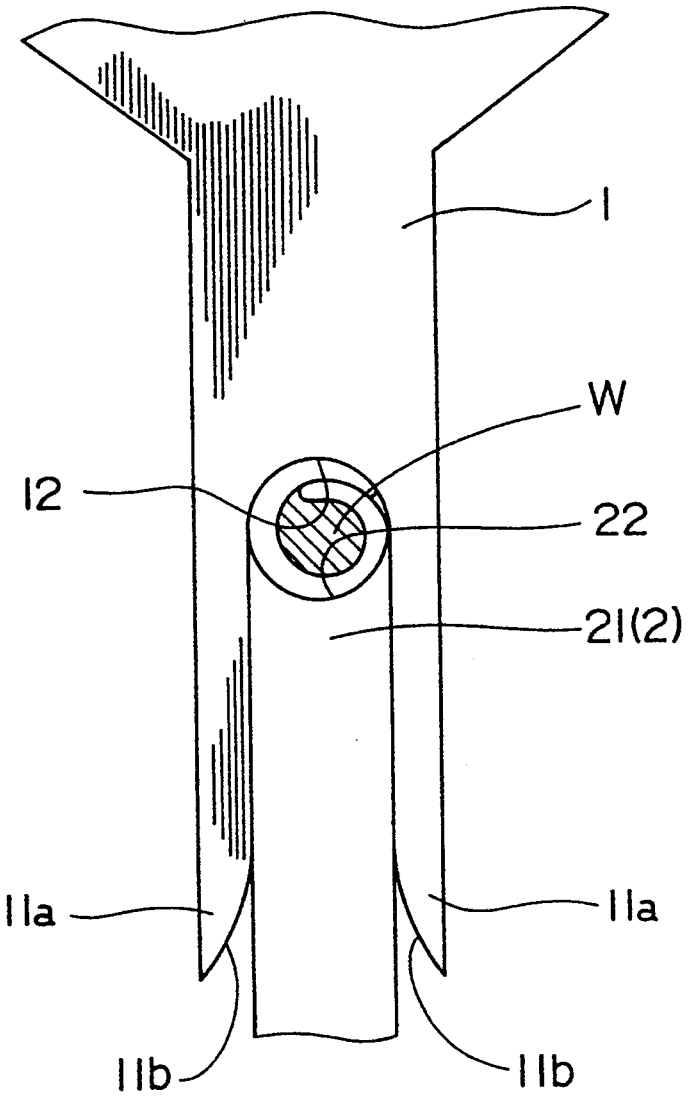
FIG. 2 is an enlarged view of FIG. 1.

FIG. 1 is a front view showing main parts of a terminal crimping apparatus according to the present invention, and FIG. 2 is an enlarged view of FIG. 1.

As shown in FIGS. 1 and 2, a terminal crimping apparatus according to the present invention comprises pressure receiving means having a pressure receiving surface receiving a crimped terminal A loaded in a connector housing C1, caulking means having a caulking surface and so opposed to the pressure receiving means as to interpose the connector housing C1 therebetween, for caulking the crimped terminal A in the connector housing C1 together with the pressure receiving means, surrounding means 11 integrally extending from the caulking means and adapted to pass through the connector housing C1 toward the pressure receiving means for surrounding the pressure receiving means with little clearance, and regulating means 3 for preventing the surrounding means 11 from being spaced farther apart at the time of caulking the crimped terminal A.

In the present embodiment, the caulking means and the surrounding means 11 are in the form of a crimper 1 which is driven back and forth in a direction in which the crimper 1 is opposed to an anvil 2. Furthermore, in the present embodiment, the pressure receiving means is in the form of the anvil 2.

Figure 3A:
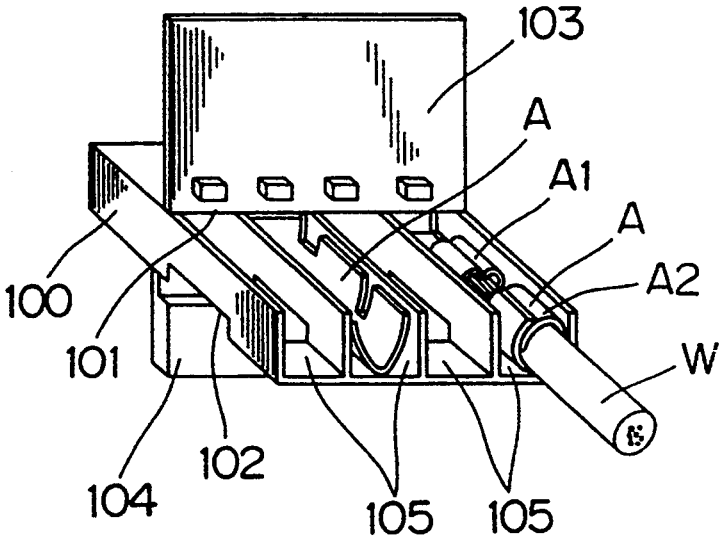
FIG. 3A PRIOR ART
FIG. 3A is a perspective view showing one example of a crimping connector.
Figure 3B:
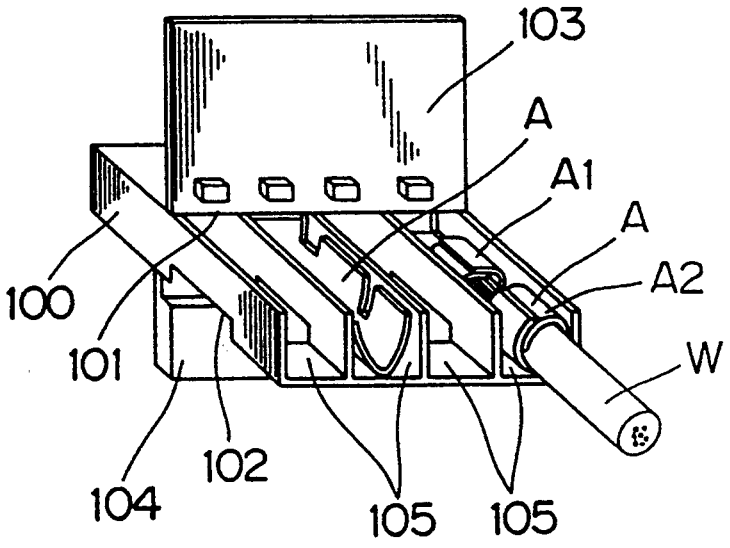
FIG. 3B PRIOR ART
FIG. 3B is a perspective view showing another example of a crimping connector.
Figure 4:
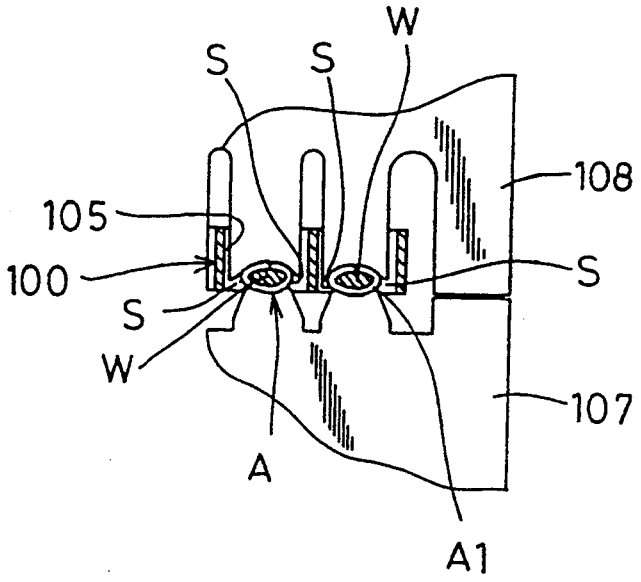
FIG. 4 PRIOR ART
FIG. 4 is a front view showing main parts of a conventional terminal crimping apparatus.
Figure 5:
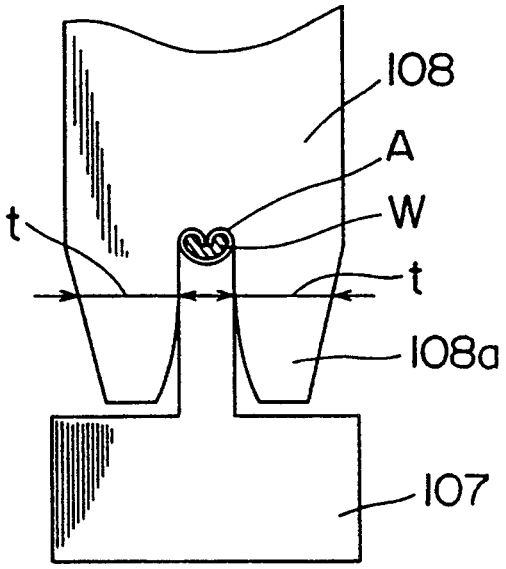
FIG. 5 PRIOR ART
FIG. 5 is a front view showing main parts of another conventional terminal crimping apparatus.

More specifically, the above described crimper 1 is so provided that it can be raised and lowered above the connector housing C1 and is pressed downward by a known pressing means 4, thereby to press a wire barrel A1 of the crimped terminal A. The crimper 1 is adapted to pass through a plurality of crimped terminal inserting portions C2 which are provided side by side in the connector housing C1. Formed at a lower side of the crimper 1 is the surrounding means or a substantially U-shaped forked portion 11 into which the above described pressure receiving means can be introduced with little clearance. The thickness t of a pair of prong parts 11*a* constituting the forked portion 11, which depends on the width of the crimped terminal inserting portion C2, is generally set to approximately 0.3 to approximately 1.0 mm. In addition, a crimping surface 12 formed into a semicircular shape is formed on a crotch portion of the forked portion 11, thereby to make it possible to caulk the wire barrel A1 in cooperation with the pressure receiving means in a state where both ends of the wire barrel A1 of the crimped terminal A are overlapped with each other. As the crimped configuration of the wire barrel A1, a so-called B-type crimp in a substantially B shape in cross section (see FIG. 5) as shown in FIG. 3A or a lap-type crimp in which an end of one of prong parts covers the other prong part as shown in FIG. 3B may be used.

Furthermore, a tapered guide portion 11*b* is formed on a lower end of each of the above described prong parts 11*a*, thereby to make it possible to introduce the pressure receiving means into the forked portion 11 easily and reliably by the guide portion 11*b*. It is preferable that a clearance between the forked portion 11 and the pressure receiving means is zero. However, there may be provided a very small clearance to which the crimped terminal A does not escape at the time of caulking.

The above described anvil 2 is fixed to a base beneath the connector housing C1. A tip 21 of the anvil 2 is projected by a predetermined height from a position 4 where the connector housing C1 is set. Consequently, the tip 21 of the anvil 2 is introduced into the crimped terminal inserting portion C2 of the connector housing C1 in a state where the connector housing C1 is set in the above described set position 4. In addition, the tip 21 of the anvil 2 has a pressure receiving surface 22 formed into a substantially semicircular shape so as to smoothly connect with the crimping surface 12 of the crimper 1.

Meanwhile, the above described crimper 1 and the above described anvil 2 are respectively composed of dice steel or the like hardened.

The above described regulating means 3 is for clamping the forked portion 11 of the crimper 1 in caulking the crimped terminal A to prevent the forked portion 11 from being deformed or being spaced farther apart, and comprises a pair of clamping members 31 for clamping the forked portion 11, a holding member 32 for holding the clamping members 31 so as to be slidable up and down, and spacers 33 for respectively adjusting the heights of the clamping members 31.

The above described clamping member 31 has a clamping surface 31*a* which is brought into contact with the forked portion 11. Formed on the opposite side of the holding surface 31*a* is a sliding surface 31*b* having an upper part gradually inclined toward the forked portion 11. In addition, each of the clamping members 31 is provided with a through hole 31*c* through which a screw N for fixing the clamping member 31 to the holding member 32 is inserted. This through hole 31*c* is formed into an elongated hole so as to allow the clamping member 31 to be adjusted upwardly or downwardly.

Furthermore, the holding member 32 comprises a groove 32*a* into which the above described clamping member 31 can be introduced, and a side surface 32*b* of the groove 32*a* is along the sliding surface 31*b* of the clamping member 31.

The spacer 33 is interposed between the base 5 for fixing the above described holding member 32 and the bottom surface of the clamping member 31. Contacting surfaces of the clamping member 31 and spacer 33 are, respectively, formed into sliding surfaces. In addition, the spacer 33 is movable in the horizontal direction along the above described base 5 so that the clamping member 31 can be adjusted upwardly or downwardly by adjusting the amount of movement of the spacer 33 in the horizontal direction. Furthermore, if the clamping member 31 is moved upwardly or downwardly, the clamping member 31 is also adjusted rightward or leftward due to the function between the side wall 32*b* of the holding member 32 and the sliding surface of the clamping member 31. The above described clamping member 31 is thus adjusted upwardly and downwardly, thereby to make it possible to make a clearance between the forked portion 11 and the clamping member 31 approximately zero.

In the above described terminal crimping apparatus, there is provided with a punch (not shown) integrally movable with the crimper 1 and interposing a coated end of the electric wire W between the punch and the bottom of the connector housing C1 to caulk the insulation barrel A2 of the crimped terminal A (see FIG. 3).

The above described connector housing C1 is the same as that shown in FIG. 3, which is automatically conveyed by a known conveying device 6. In the present embodiment, the crimped terminal inserting portions C2 provided for the connector housing C1 can be sequentially moved to a space between the crimper 1 and the anvil 2 by the above described conveying device 6. Consequently, the clamped terminals A in the respective crimped terminal inserting portions C1 can be sequentially crimped.

More specifically, in crimping the electric wire W, the electric wire W is subjected to a measuring and cutting process for cutting the electric wire W to predetermined lengths and a stripping process for stripping the cut electric wire W to expose a conductor in an end of the electric wire W, which are not shown. An electric wire guiding device for embodying the respective processes is disclosed in detail in Japanese Patent Application Serial No. 4-165666.

In the above described construction, the crimper 1 is lowered in a state where the connector housing C1 is set by the conveying device 6, thereby to make it possible for the crimper 1 to pass through the crimped terminal inserting portion C2 of the connector housing C1, and the wire barrel A1 of the crimped terminal A loaded in the crimped terminal inserting portion C2 is interposed and caulked between the crimping surface of the crimper 1 and the pressure receiving surface 22 of the anvil 2, thereby to make it possible to crimp the wire barrel A1 against the conductor of the electric wire W. In the case of the above described crimping, the forked portion 11 of the crimper 1 which passes through the crimped terminal inserting portion C2 is interposed by the regulating means 3, thereby the regulating means 3 makes it possible to prevent the forked portion 11 from being spaced farther apart. Accordingly, the wire barrel A of the crimped terminal A can be surrounded with little clearance between the above described crimping surface 12 and the above described pressure receiving surface. Therefore, the wire barrel A1 can be caulked at significantly high pressure, thereby to make it possible to achieve a compression rate of 70 to 90% as the compression rate of the electric wire W. Consequently, it is possible to crimp the wire barrel A1 of the crimped terminal A reliably and firmly against the conductor of the electric wire W.

The terminal crimping apparatus according to the present invention is not limited to the above described embodiment. For example, the above described regulating means 3 may be formed integrally with the anvil 2.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A terminal crimping apparatus comprising:

pressure receiving means having a pressure receiving surface for receiving a terminal to be crimped loaded in a connector housing;

caulking means having a caulking surface opposed to the pressure receiving means so as to interpose the connector housing therebetween for caulking a terminal to be crimped in the connector housing against said pressure receiving means;

surrounding means integrally extending from said caulking means for surrounding said pressure receiving means such that substantially no clearance exists between said pressure receiving means and said surrounding means when said caulking means caulks a terminal against said pressure receiving means, said surrounding means having at least a portion adapted to pass through the connector housing toward said pressure receiving means when said caulking means caulks a terminal against said pressure receiving means; and regulating means for preventing said at least a portion of said surrounding means from being deformed when said caulking means caulks a terminal against said pressure receiving means.

2. The terminal crimping apparatus according to claim 1, wherein said pressure receiving means is separate from said regulating means.

3. The terminal crimping apparatus according to claim 1, wherein said pressure receiving surface of said pressure receiving means is formed into a substantially semicircular shape so as to smoothly meet with said caulking surface.

4. The terminal crimping apparatus according to claim 3, wherein said caulking surface of said caulking means is formed into such a semicircular shape as to allow a wire barrel of a terminal to be crimped.

5. The terminal crimping apparatus according to claim 1, wherein said pressure receiving surface of said pressure receiving means projects toward an inside of the connector housing by a predetermined amount from a position where the connector housing is set.

6. The terminal crimping apparatus according to claim 1, wherein said pressure receiving surface of said pressure receiving means is formed at a tip of an anvil.

7. The terminal crimping apparatus according to claim 1, wherein said caulking surface of said caulking means and said surrounding means are integrated with a crimper which is driven back and forth along a direction in which said crimper is opposed to said pressure receiving means.

8. The terminal crimping apparatus according to claim 7, wherein said crimper and said pressure receiving means are opposed to each other through openings formed in opposite sides of the connector housing and communicating with a terminal inserting portion of the connector housing.

9. The terminal crimping apparatus according to claim 7, wherein said crimper and said pressure receiving means are respectively composed of hardened dice steel.

10. The terminal crimping apparatus according to claim 1, wherein said surrounding means is a U-shaped forked member.

11. The terminal crimping apparatus according to claim 10, wherein each of a pair of prong parts constituting said forked member have a tapered guide portion capable of guiding said pressure receiving means toward said caulking means.

12. The terminal crimping apparatus according to claim 10, wherein said forked member is formed of a pair of prong parts having a thickness ranging from approximately 0.3 mm to approximately 1.0 mm.

13. The terminal crimping apparatus according to claim 10, wherein said regulating means includes a holding member fixed to a mounting portion and a pair of clamping members, each of said clamping members being movably held by said holding member to clamp said surrounding means such that a distance between said clamping member and said surrounding means can be adjusted.

14. The terminal crimping apparatus according to claim 13, wherein said regulating means further includes spacers for positioning said respective clamping members in predetermined positions relative to said holding member.

15. The terminal crimping apparatus according to claim 13, wherein said holding member holds said clamping members via fixing means passing through an elongated hole formed in said clamping members, so that each of said clamping members is movable in a predetermined direction.

16. The terminal crimping apparatus according to claim 14, wherein said clamping members each have clamping surfaces opposed to each other for clamping said surrounding means and sliding surfaces formed on an opposite side of said clamping surfaces and inclined toward said clamping surfaces;

said holding member has a side wall along said sliding surfaces of each of the clamping members; and said spacers are movable such that said clamping members are slidable along said side walls of said holding member.

* * * * *